US008439210B1

(12) United States Patent
Griffith

(10) Patent No.: US 8,439,210 B1
(45) Date of Patent: May 14, 2013

(54) WIG AND HAIRPIECE HOLDER

(76) Inventor: Tanya Griffith, Tampa, FL (US)

( * ) Notice: Subject to any disclaimer, the term of this patent is extended or adjusted under 35 U.S.C. 154(b) by 215 days.

(21) Appl. No.: 12/927,848

(22) Filed: Nov. 29, 2010

(51) Int. Cl.
*A47G 25/10* (2006.01)
*A47G 25/06* (2006.01)
*A47G 25/746* (2006.01)

(52) U.S. Cl.
USPC ..... 211/119.004; 211/32; 211/106.01; 211/85.3

(58) Field of Classification Search ..... 211/113, 211/119, 106, 106.01, 119.004, 119.009, 211/30–33, 85.3, 181.1; 223/66
See application file for complete search history.

(56) References Cited

U.S. PATENT DOCUMENTS

| | | | | | |
|---|---|---|---|---|---|
| D46,150 | S | * | 7/1914 | Webb | D6/559 |
| 1,984,827 | A | * | 12/1934 | Derman | 312/4 |
| 2,937,762 | A | * | 5/1960 | Deuter | 211/106.01 |
| 3,506,112 | A | | 4/1970 | Feinberg et al. | |
| 3,568,899 | A | | 3/1971 | Rosenberg | |
| 3,602,372 | A | * | 8/1971 | Verrecchio | 211/100 |
| 3,650,441 | A | | 3/1972 | Lindgren | |
| 3,750,869 | A | | 8/1973 | Kartiganer | |
| 3,820,694 | A | | 6/1974 | Pabis | |
| 4,616,747 | A | | 10/1986 | Zimmerman | |
| 5,044,522 | A | * | 9/1991 | Roig et al. | 222/108 |
| 5,255,401 | A | * | 10/1993 | Sambrookes et al. | 4/605 |
| 5,356,061 | A | * | 10/1994 | Yu | 224/275 |
| 5,875,902 | A | * | 3/1999 | Emery et al. | 211/90.03 |
| 6,152,313 | A | * | 11/2000 | Klein et al. | 211/113 |
| 6,520,351 | B1 | * | 2/2003 | Zadro | 211/119 |
| 7,789,248 | B1 | * | 9/2010 | Salerno et al. | 211/85.7 |
| 7,866,493 | B1 | * | 1/2011 | Hurt et al. | 211/119.004 |
| 7,931,160 | B2 | * | 4/2011 | Newbouild et al. | 211/90.02 |
| 8,083,079 | B2 | * | 12/2011 | Rosen | 211/119.001 |
| 2003/0121871 | A1 | * | 7/2003 | Zadro | 211/119 |
| 2006/0108193 | A1 | | 5/2006 | Lee et al. | |
| 2006/0266721 | A1 | * | 11/2006 | Gregory | 211/85.3 |
| 2008/0164384 | A1 | * | 7/2008 | Rosen | 248/117.1 |

* cited by examiner

*Primary Examiner* — Jennifer E. Novosad
(74) *Attorney, Agent, or Firm* — Richard L. Mikesell

(57) ABSTRACT

A storage unit for wigs. The unit is attached to a door and hangs from the top of the door. The unit has head-shaped pedestals on which wigs are mounted as well as a ventilated accessory storage container and accessory supporting hooks which are pendently supported from the accessory storage container.

2 Claims, 1 Drawing Sheet

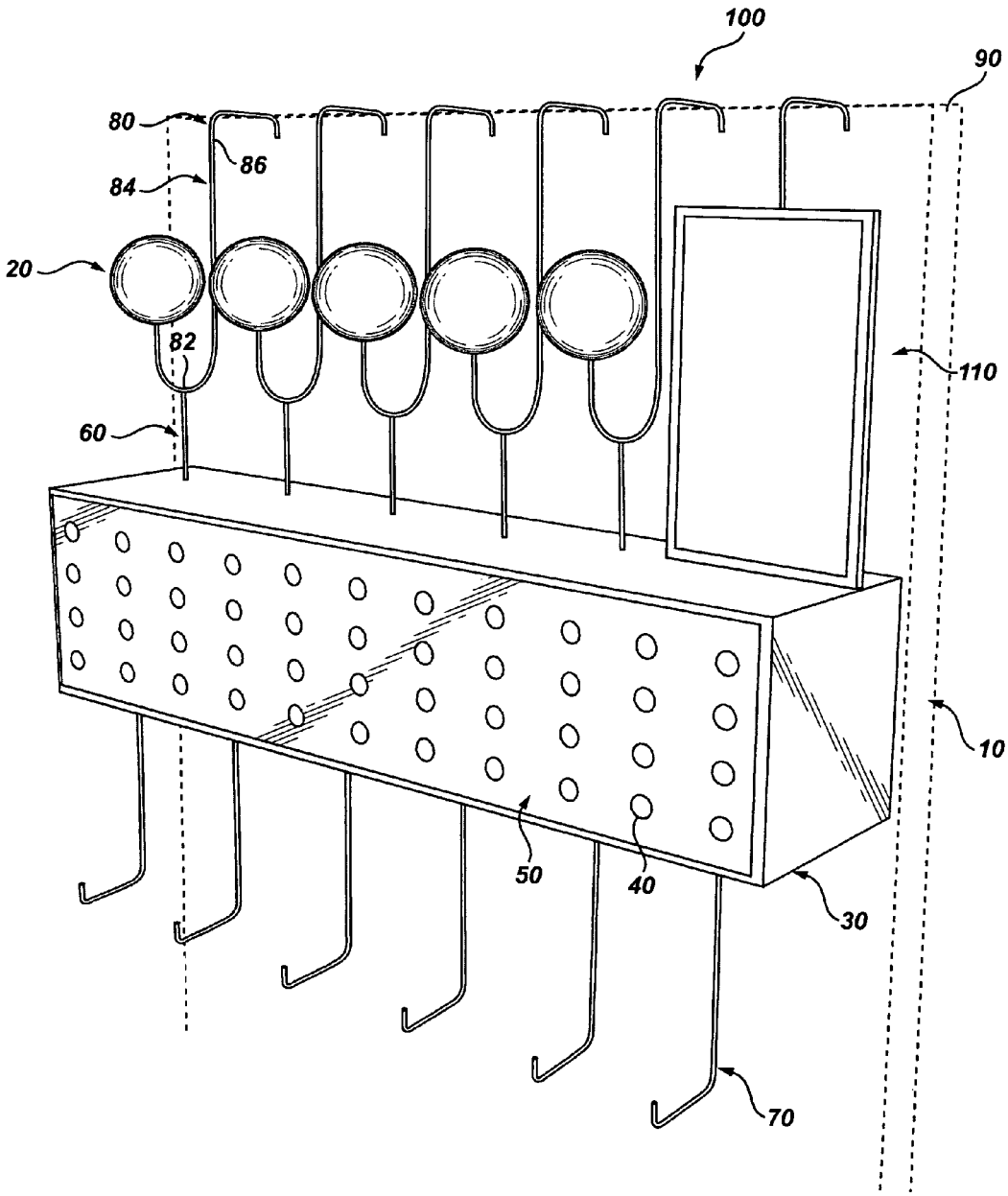
100
90
80
86
84
20
82
110
60
10
50
40
30
70

WIG AND HAIRPIECE HOLDER

TECHNICAL FIELD OF THE INVENTION

The present invention relates to the general art of containers, and to the particular field of containers that are adapted to store wigs and hairpieces.

BACKGROUND OF THE INVENTION

Wigs are normally styled or "set" by a professional beauty operator which is an expensive procedure. The main problem with the storage of the modern type of wig is that it is best stored on a headform, rather than being laid flat as in a case, in order to maintain the styling of the hair and to avoid damage or disarrangement of the hair.

A hairpiece worn by a man or woman must be properly cared for in order to maintain its natural appearance. Although typically such care includes grooming and cleaning the hairpiece, it is also important to properly store the hairpiece when not being worn. In the past, storage and carrying cases for hairpieces have merely provided a compartment in which the hairpiece is placed, or if a spherical head-like frame is provided to support the hairpiece, the front, rear and side portions of the hairpiece have been allowed to merely hang freely. Neither arrangement is conducive to maintaining the hairpiece while in storage in a simulated natural style as worn by a user. For example, men typically have the front portion or bangs of the hairpiece combed or brushed backwardly off the forehead. However, if the front portion of the hairpiece is allowed to hang freely in the case or is merely placed within a compartment in the case the front portion of the hairpiece tends to "set" in a downwardly hanging position such that it is difficult to comb or brush the front portion of the hairpiece rearwardly off a user's forehead.

It is therefore desirable to provide a storage and carrying case which will maintain a hairpiece in a simulated natural style of arranging hair.

Today, it is not an uncommon situation for a person to own or possess a plurality of such false hairpieces. Yet, there has not been developed heretofore a convenient device for ready storage of these hairpieces. When purchased the hairpieces are normally placed in boxes and they remain there until ready for use. When a user owns a plurality of hairpieces the plurality of storage boxes therefor leads to a cluttering and state of disarray in closets, on dressers and wherever the storage boxes are placed. Accordingly, there is a need for a means for properly storing a plurality of wigs in a convenient and efficient manner.

Furthermore, many people have many accessories associated with their wigs. These accessories must also be stored. This also creates problems, and there is a need for a means for storing wigs and associated wig accessories in an efficient and convenient manner.

While the inventor is aware of several carrying cases that are suitable for carrying a wig and several wig stands, and even containers that have a plurality of compartments, the inventor is not aware of any means for storing a plurality of wigs along with associated accessories in a convenient and efficient manner.

SUMMARY OF THE INVENTION

The above-discussed disadvantages of the prior art are overcome by a storage unit for wigs. The unit is attached to a door and hangs from the top of the door. The unit has head-shaped pedestals on which wigs are mounted as well as a ventilated accessory storage container and accessory supporting hooks which are pendently supported from the accessory storage container.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the view.

The sole FIGURE is a perspective view of a wig and hairpiece storage unit embodying the present invention.

DETAILED DESCRIPTION OF THE INVENTION

Referring to the FIGURE, it can be understood that the present invention is embodied in unit 10 for storing wigs in a convenient and efficient manner and which comprises a plurality of spherical wig-holding elements, such as element 20 on which a wig or hair piece is supported. A container 30 is adapted for storing wig-related accessories and includes a plurality of ventilation holes, such as ventilation hole 40, defined therein and a door 50 is hingeably attached to the body of the container so access to the interior thereof can be gained through the door in a manner that will be understood by one skilled in the art based on the teaching of the present disclosure. The storage container is located closely adjacent to the wigs whereby all accessories are located in a convenient location with respect to the wigs so efficient storage is achieved. The ventilation holes permit air to circulate as necessary to maintain proper storage conditions for the accessories. In fact, if desired and suitable, wigs and other hairpieces can also be stored in the container and will receive proper ventilation while in storage.

A support element, such as support element 60, mounts each of the wig-holding elements on the container, and a plurality of J-shaped hooks, such as hook 70, are supported on the container to depend therefrom when the container is in a use orientation, with the container and unit being shown in the FIGURE in the use orientation. Accessories, such as belts, ties, scarves, purses and the like can be stored on the hooks.

The unit further includes a plurality hook elements, such as hook element 80, each of which is fixed adjacent to one end 82 thereof to the wig-holding element and has a U-shaped hook 84 adjacent to another end 86 thereof. The U-shaped hook of each hook element is spaced apart from the wig-holding element associated therewith to be located above that wig-holding element when in a use orientation. Each of the U-shaped hook elements is sized and positioned to fit over the top edge 90 of a door 100 whereby the wig-holding element, the container and the support elements are dependently supported from the top edge of the door when in use. Each hook element is one piece with the support element associated therewith.

Unit 10 further includes a mirror 110 mounted on the container adjacent to one of the wig-supporting elements.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A unit for storing wigs comprising:

a) a plurality of spherical wig-holding elements;

b) a container that is adapted for storing wig-related accessories, the container including a plurality of ventilation holes defined therein and a door;

c) a support element mounting each of the wig-holding elements on the container;

d) a plurality of j-shaped hooks supported on the container to depend therefrom when the container is in a use orientation;

e) a plurality of hook elements each of which is fixed adjacent to one end thereof to the wig-holding element and has a u-shaped hook adjacent to another end thereof, the u-shaped hook of each hook element being spaced apart from the wig-holding element associated therewith to be located above that wig-holding element when in a use orientation, each of the u-shaped hook elements being sized and positioned to fit over the top edge of a door whereby the wig-holding element, the container and the support elements are dependently supported from the top edge of the door when in use, each hook element being one piece with the support element associated therewith; and f) a mirror mounted on the container adjacent to one of the wig-supporting elements.

2. A unit for storing wigs comprising:

a) a door having a top edge;

b) a plurality of spherical wig-holding elements;

c) a container that is adapted for storing wig-related accessories, the container including a plurality of ventilation holes defined therein and a door hingeably mounted on the container;

d) a support element mounting each of the wig-holding elements on the container;

e) a plurality of j-shaped hooks supported on the container to depend therefrom when the container is in a use orientation;

f) a plurality hook elements each of which is fixed adjacent to one end thereof to the wig-holding element and has a u-shaped hook adjacent to another end thereof, the u-shaped hook of each hook element being spaced apart from the wig-holding element associated therewith to be located above that wig-holding element when in a use orientation, each of the u-shaped hook elements being sized and positioned to fit over the top edge of the door whereby the wig-holding element, the container and the support elements are dependently supported from the top edge of the door when in use, each hook element being one piece with the support element associated therewith; and g) a mirror mounted on the container adjacent to one of the wig-supporting elements.

* * * * *